US009316084B2

(12) United States Patent
Carter et al.

(10) Patent No.: US 9,316,084 B2
(45) Date of Patent: Apr. 19, 2016

(54) EXPANDABLE SEAT ASSEMBLY FOR ISOLATING FRACTURE ZONES IN A WELL

(71) Applicant: UTEX INDUSTRIES, INC., Houston, TX (US)

(72) Inventors: Derek L. Carter, Houston, TX (US); Mark Henry Naedler, Cypress, TX (US)

(73) Assignee: UTEX Industries, Inc., Houston, TX (US)

( * ) Notice: Subject to any disclaimer, the term of this patent is extended or adjusted under 35 U.S.C. 154(b) by 601 days.

(21) Appl. No.: 13/715,535

(22) Filed: Dec. 14, 2012

(65) Prior Publication Data

US 2013/0153220 A1 Jun. 20, 2013

Related U.S. Application Data

(60) Provisional application No. 61/570,564, filed on Dec. 14, 2011.

(51) Int. Cl.
*E21B 33/128* (2006.01)
*E21B 34/14* (2006.01)
*E21B 43/26* (2006.01)

(52) U.S. Cl.
CPC ..... *E21B 33/128* (2013.01); *E21B 34/14* (2013.01); *E21B 43/26* (2013.01)

(58) Field of Classification Search
CPC ... E21B 34/14; E21B 2034/002; E21B 43/26; E21B 33/128
USPC ..... 166/173, 193, 194, 195; 285/321
See application file for complete search history.

(56) References Cited

U.S. PATENT DOCUMENTS

| | | | |
|---|---|---|---|
| 2,947,363 | A | 8/1960 | Sackett et al. |
| 2,973,006 | A | 2/1961 | Nelson |
| 3,554,281 | A | 1/1971 | Elver |
| 3,568,768 | A | 3/1971 | Rowell, Jr. |
| 3,667,505 | A | 6/1972 | Radig |
| 3,885,627 | A | 5/1975 | Berry et al. |
| 4,044,835 | A | 8/1977 | Mott |
| 4,252,196 | A | 2/1981 | Silberman et al. |

(Continued)

OTHER PUBLICATIONS

Definition of Young's Modulus; Encyclopedia Britannica; http://www.britannica.com/EBchecked/topic/654186/Youngs-modulus.*

(Continued)

*Primary Examiner* — Blake Michener
*Assistant Examiner* — Christopher Sebesta
(74) *Attorney, Agent, or Firm* — Haynes and Boone, LLP

(57) ABSTRACT

An expandable fracture ball seat assembly for use in wellbore zone fracturing operations functions to permit passage therethrough and exit therefrom of fracture ball plugs of only diameters less than a predetermined magnitude. In a representative form, the seat assembly includes a ring stack disposed within a tubular member and formed from a first expandable ring coaxially sandwiched between a setting ring and a second expandable ring. When an oversized fracture ball plug is forced into the seat assembly it axially compresses the ring stack and reduces the diameter of the first expandable ring and telescopes it into the second expandable ring, with the first expandable ring and the setting ring blocking passage through and exit from the seat. A reverse passage of a suitably large diameter fracture ball plug through the seat assembly axially returns the setting ring and first expandable ring to their original positions.

37 Claims, 14 Drawing Sheets

(56) References Cited

U.S. PATENT DOCUMENTS

| | | | | |
|---|---|---|---|---|
| 4,292,988 | A | 10/1981 | Montgomery | |
| 4,448,216 | A | 5/1984 | Speegle et al. | |
| 4,510,994 | A | 4/1985 | Pringle | |
| 4,537,383 | A | 8/1985 | Fredd | |
| 4,583,593 | A | 4/1986 | Zunkel et al. | |
| 4,828,037 | A | 5/1989 | Lindsey et al. | |
| 5,146,992 | A | 9/1992 | Baugh | |
| 5,165,473 | A | 11/1992 | Bode | |
| 5,244,044 | A | 9/1993 | Henderson | |
| 5,297,580 | A | 3/1994 | Thurman | |
| 5,813,483 | A | 9/1998 | Latham et al. | |
| 5,960,881 | A | 10/1999 | Allamon et al. | |
| 6,003,607 | A | 12/1999 | Hagen et al. | |
| 6,032,734 | A | 3/2000 | Telfer | |
| 6,053,250 | A | 4/2000 | Echols | |
| 6,155,350 | A | 12/2000 | Melenyzer | |
| 6,179,339 | B1 * | 1/2001 | Vila | 285/111 |
| 6,189,618 | B1 | 2/2001 | Beeman et al. | |
| 6,390,200 | B1 | 5/2002 | Allamon et al. | |
| 6,681,860 | B1 | 1/2004 | Yokley et al. | |
| 6,725,935 | B2 | 4/2004 | Szarka et al. | |
| 6,799,638 | B2 | 10/2004 | Butterfield, Jr. | |
| 6,866,100 | B2 | 3/2005 | Gudmestad et al. | |
| 6,966,368 | B2 | 11/2005 | Farquhar | |
| 7,134,505 | B2 | 11/2006 | Fehr et al. | |
| 7,464,764 | B2 | 12/2008 | Xu | |
| 7,503,392 | B2 | 3/2009 | King et al. | |
| 7,628,210 | B2 | 12/2009 | Avant et al. | |
| 7,637,323 | B2 | 12/2009 | Schasteen et al. | |
| 7,644,772 | B2 | 1/2010 | Avant et al. | |
| 7,647,964 | B2 | 1/2010 | Akbar et al. | |
| 7,673,677 | B2 | 3/2010 | King et al. | |
| 7,681,645 | B2 | 3/2010 | McMillin et al. | |
| 7,694,732 | B2 | 4/2010 | Rogers et al. | |
| 7,921,922 | B2 | 4/2011 | Darnell et al. | |
| 8,151,891 | B1 | 4/2012 | Darnell et al. | |
| 2005/0126638 | A1 | 6/2005 | Gilbert | |
| 2006/0213670 | A1 * | 9/2006 | Bishop et al. | 166/386 |
| 2007/0272413 | A1 * | 11/2007 | Rytlewski et al. | 166/318 |
| 2008/0066924 | A1 | 3/2008 | Xu | |
| 2008/0217025 | A1 | 9/2008 | Rudock et al. | |
| 2009/0044946 | A1 | 2/2009 | Schasteen et al. | |
| 2009/0044955 | A1 * | 2/2009 | King et al. | 166/374 |
| 2009/0159289 | A1 * | 6/2009 | Avant et al. | 166/316 |
| 2009/0266659 | A1 * | 10/2009 | Lembcke et al. | 188/268 |
| 2010/0101803 | A1 | 4/2010 | Clayton et al. | |
| 2010/0212911 | A1 * | 8/2010 | Chen et al. | 166/373 |
| 2011/0203800 | A1 * | 8/2011 | Tinker et al. | 166/318 |
| 2012/0012771 | A1 * | 1/2012 | Korkmaz et al. | 251/315.07 |

OTHER PUBLICATIONS

International Search Report and Written Opinion for PCT/US2012/069883 by ISA/ Korean Intellectual Property Office on Apr. 12, 2013.

* cited by examiner

EXPANDABLE SEAT ASSEMBLY FOR ISOLATING FRACTURE ZONES IN A WELL

FIELD OF THE INVENTION

The present invention relates to a fracture plug seat assembly used in well stimulation for engaging and creating a seal when a plug, such as a ball, is dropped into a wellbore and landed on the fracture plug seat assembly for isolating fracture zones in a well. More particularly, the present invention relates to a fracture plug seat that includes an expandable seat to allow balls to pass through its interior by expanding and then restricts expansion and locks when the designated ball is dropped.

BACKGROUND

In well stimulation, the ability to perforate multiple zones in a single well and then fracture each zone independently, referred to as "zone fracturing", has increased access to potential reserves. Many gas wells are drilled with zone fracturing planned at the well's inception. Zone fracturing helps stimulate the well by creating conduits from the formation for the hydrocarbons to reach the well. A well drilled with planned fracturing zones will be equipped with a string of piping below the cemented casing portion of the well. The string is segmented with packing elements, fracture plugs and fracture plug seat assemblies to isolate zones. A fracture plug, such as a ball or other suitably shaped structure (hereinafter referred to collectively as a "ball") is dropped or pumped down the well and seats on the fracture plug seat assembly, thereby isolating pressure from above.

Typically, a fracture plug seat assembly includes a fracture plug seat having an axial opening of a select diameter. To the extent multiple fracture plugs are disposed along a string, the diameter of the axial opening of the respective fracture plug seats becomes progressively smaller with the depth of the string. This permits a plurality of balls having a progressively increasing diameter, to be dropped (or pumped), smallest to largest diameter, down the well to isolate the various zones, starting from the toe of the well and moving up. When the well stimulation in a particular zone is complete, the ball is removed from the fracture plug seat.

In order to maximize the number of zones and therefore the efficiency of the well, the difference in the axial opening diameter of adjacent fracture plug seats and the diameter of the balls designed to be caught by such fracture plug seats is very small, and the consequent surface area of contact between the ball and its seat is very small. Due to the high pressure that impacts the ball during a hydraulic fracturing process, the balls often become stuck and difficult to remove from the fracture plug seats despite being designed to return to the surface due to pressure from within the formation. In such instances, the balls must be removed from the string by costly and time-consuming milling or drilling processes.

FIG. 1 illustrates a prior art fracture plug seat assembly 10 disposed along a tubing string 12. Fracture plug seat assembly 10 includes a metallic, high strength composite or other rigid material seat 14 mounted on a sliding sleeve 16 which is movable between a first position and a second position. In the first position shown in FIG. 1, sleeve 16 is disposed to inhibit fluid flow through radial ports 18 from annulus 20 into the interior of tubing string 20. Packing element 22 is disposed along tubing string 12 to restrict fluid flow in the annulus 20 formed between the earth 24 and the tubing string 12.

FIG. 2 illustrates the prior art fracture plug seat assembly 10 of FIG. 1, but with a ball 26 landed on the metallic, high strength composite or other rigid material seat 14 and with sliding sleeve 16 in the second position. With ball 26 landed on the metallic, high strength composite or other rigid material seat 14, fluid pressure 28 applied from uphole of fracture plug seat assembly 10 urges sliding sleeve 16 into the second position shown in FIG. 2, thereby exposing radial ports 18 to permit fluid flow therethrough, diverting the flow to the earth 24.

As shown in FIGS. 1 and 2, the metallic, high strength composite or other rigid material seat 14 has a tapered surface 30 that forms an inverted cone for the ball or fracture plug 26 to land upon. This helps translate the load on the ball 26 from shear into compression, thereby deforming the ball 26 into the metallic, high strength composite or other rigid material seat 14 to form a seal. In some instances, the surface of such metallic, high strength composite or other rigid material seats 14 have been contoured to match the shape of the ball or fracture plug 26. One drawback of such metallic, high strength composite or other rigid material seats 14 is that high stress concentrations in the seat 14 are transmitted to the ball or fracture plug 26. For various reasons, including specific gravity and ease of milling, balls or fracture plugs 26 are often made of a composite plastic. Also, efforts to maximize the number of zones in a well has reduced the safety margin of ball or fracture plug failure to a point where balls or fracture plugs can extrude, shear or crack under the high pressure applied to the ball or fracture plug during hydraulic fracturing operations. As noted above, when the balls 26 extrude into the metallic, high strength composite or other rigid material seat 14 they become stuck. In such instances, the back pressure from within the well below is typically insufficient to purge the ball 26 from the seat 14, which means that an expensive and time-consuming milling process must be conducted to remove the ball 28 from the seat 14.

Other prior art fracture plug seat assembly designs include mechanisms that are actuated by sliding pistons and introduce an inward pivoting mechanical support beneath the ball. These designs also have a metallic, high strength composite or other rigid material seat, but are provided with additional support from the support mechanism. These fracture plug seat assembly designs can be described as having a normally open seat that closes when a ball or fracture plug is landed upon the seat. Such normally open fracture plug seat assembly designs suffer when contaminated with the heavy presence of sand and cement.

DETAILED DESCRIPTION

The method and apparatus of the present invention provides a fracture plug seat assembly used in well stimulation for engaging and creating a seal when a plug, such as a ball, is dropped into a wellbore and landed on the fracture plug seat assembly for isolating fracture zones in a well. The fracture plug seat assembly has a fracture plug seat that includes a setting ring, an expandable ring and a lower ring that are capable of locking when a ball that is too large to pass through the setting ring is landed on the fracture plug seat assembly. The setting ring and lower ring collectively form what may be termed an expansion control portion of the overall fracture plug seat assembly. When a ball or fracture plug that is small enough to pass through the setting ring contacts the expandable ring, the expandable ring expands to allow the ball to pass. When the ball designed to plug the seat is launched, it engages the setting ring and actuates the expandable ring into a retracted and locked position in which further expansion is prevented, hence supporting the ball.

Figure 1:
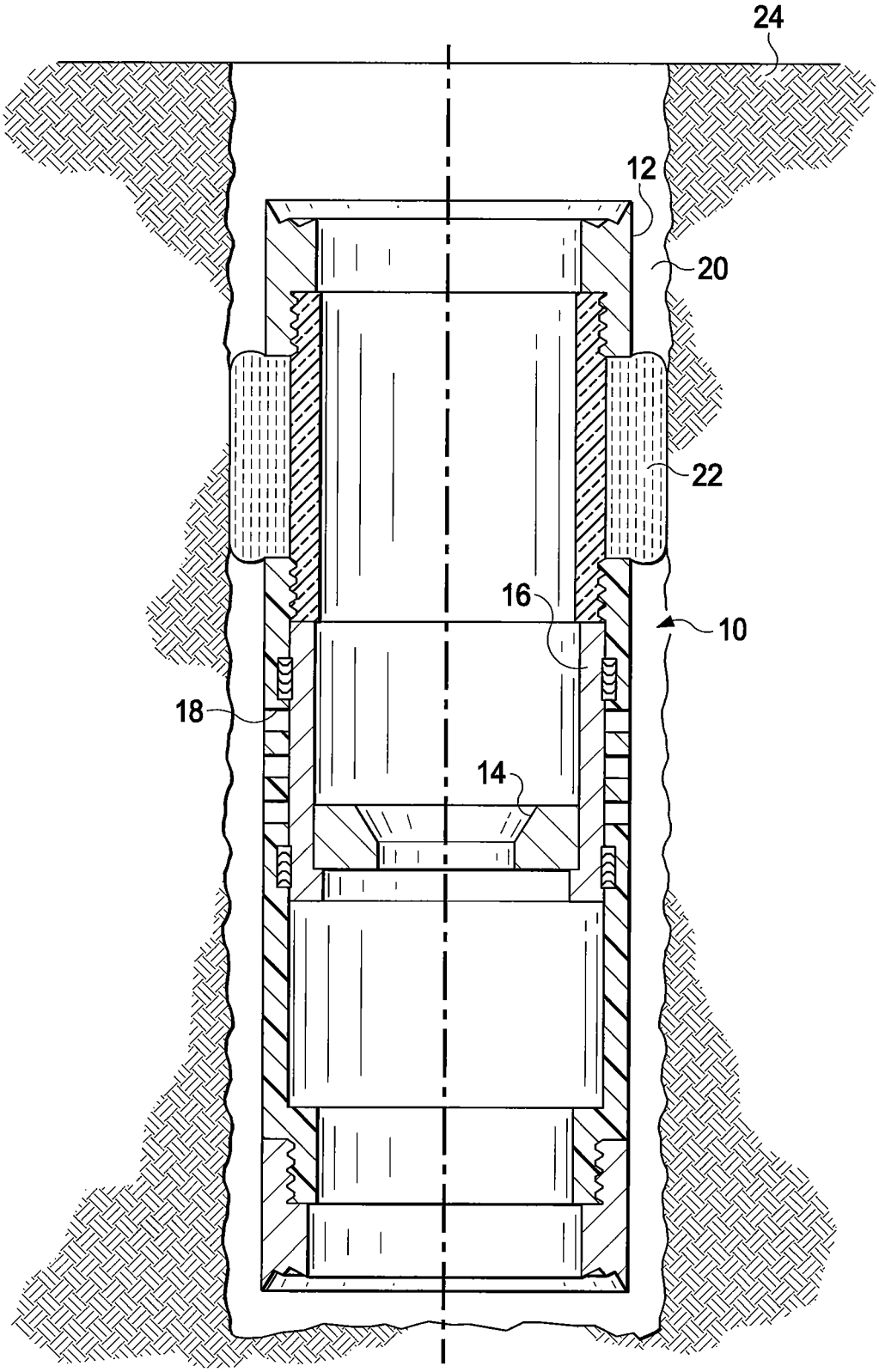
FIG. 1 illustrates a prior art fracture plug seat assembly positioned in a well bore.
Figure 2:
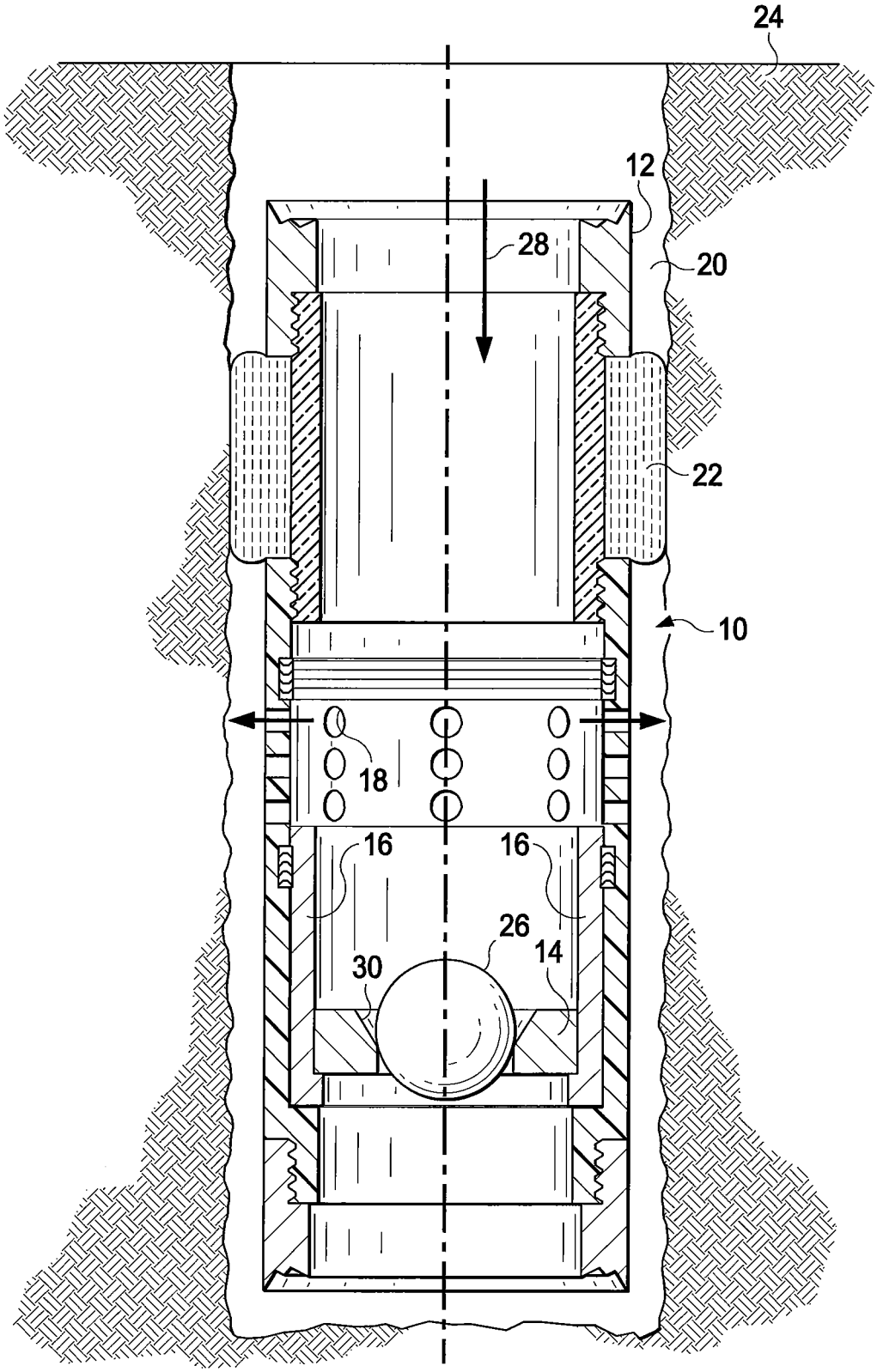
FIG. 2 illustrates the prior art fracture plug seat assembly of FIG. 1 with a ball landed on the seat of the fracture plug seat assembly.
Figure 3:
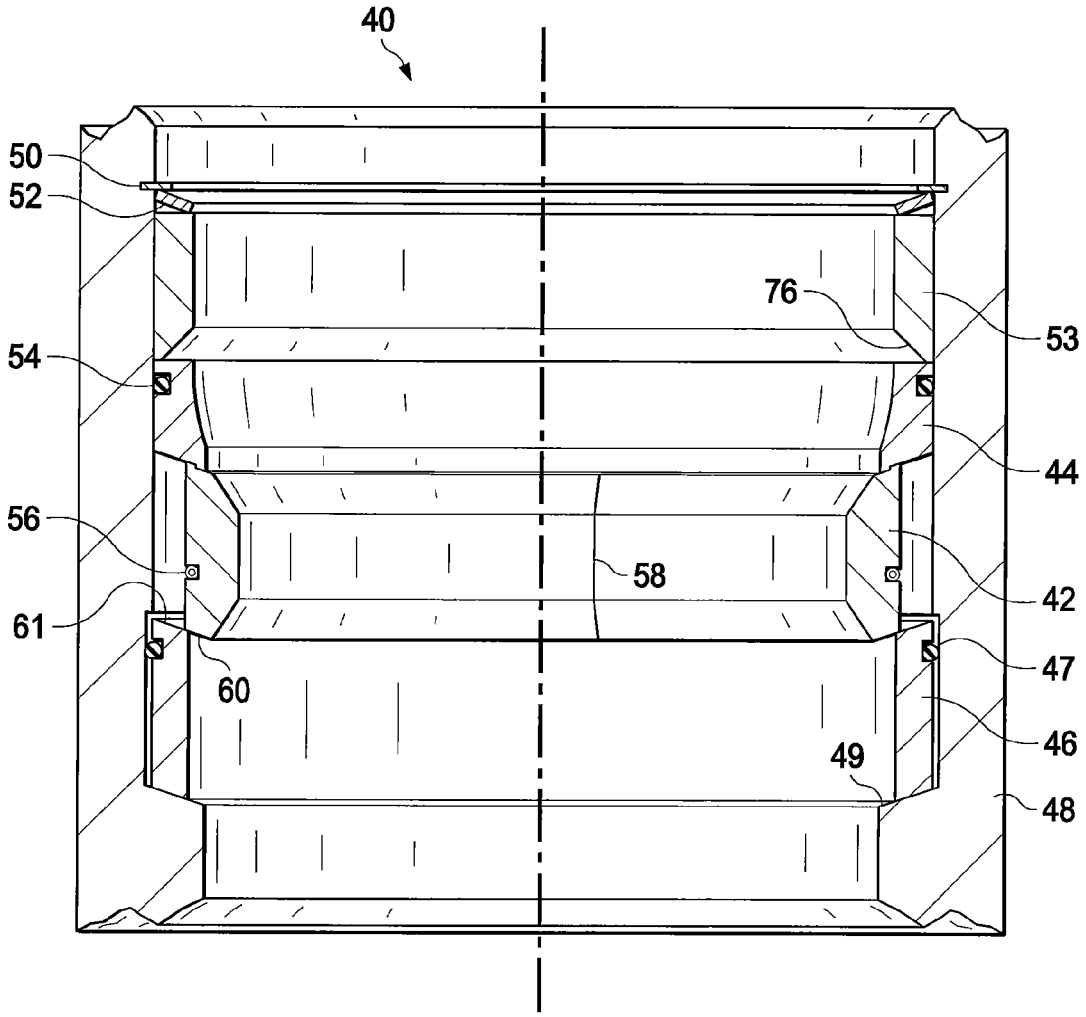
FIG. 3 illustrates a cross-section of a fracture plug seat assembly incorporating an embodiment of the fracture plug seat of the present invention.

FIG. 3 illustrates a cross-section of an embodiment of a fracture plug seat assembly 40 according to the present invention. As shown in FIG. 3, the fracture plug seat assembly 40 includes an expandable ring 42 having an axial opening, a setting ring 44 having an axial opening and a lower ring 46 having an axial opening. According to the embodiment shown in FIG. 3, the lower ring 46 is also capable of expanding when sufficient force is applied by the expandable ring 42 thereby allowing the expandable ring 42 to move to a locked position. In certain embodiments, the setting ring 44 is integrated with the sleeve 48. In certain other embodiments, the setting ring 44 may be held axially in the initial position shown in FIG. 3 by means such as shear pins to prevent expandable ring 42 from moving prematurely to a locked position until the ball designed to plug the fracture plug seat assembly 40 is landed on the setting ring 44.

The fracture plug seat assembly 40 shown in FIG. 3 also contains a snap ring 50 which retains the assembly components, namely the expandable ring 42, the setting ring 44 and the lower ring 46, within the sleeve 48. A Belleville washer or coned-disc spring 52 keeps pressure on the stack of rings, via an annular spacer 53 bearing on the top side of the setting ring 44, so that contact between the rings is maintained and so that sand and cement cannot penetrate between the rings. Setting ring 44 has an O-ring seal 54 which prevents fluid from passing between the setting ring 44 and the sleeve 48. Expandable ring 42 has a split 58 and a spring 56 which biases the split 58 of the expandable ring 42 to a closed position as shown in FIG. 3. The expandable ring 42 and the lower ring 46 have respective mating tapered surfaces 60 and 61 which maintain the expandable ring 42 and the lower ring 46 in an axial relationship and initiates expansion of the lower ring 46 when pressure is applied by the expandable ring 42. The lower ring 46 includes an O-ring 47 for centering purposes.

Figure 4:
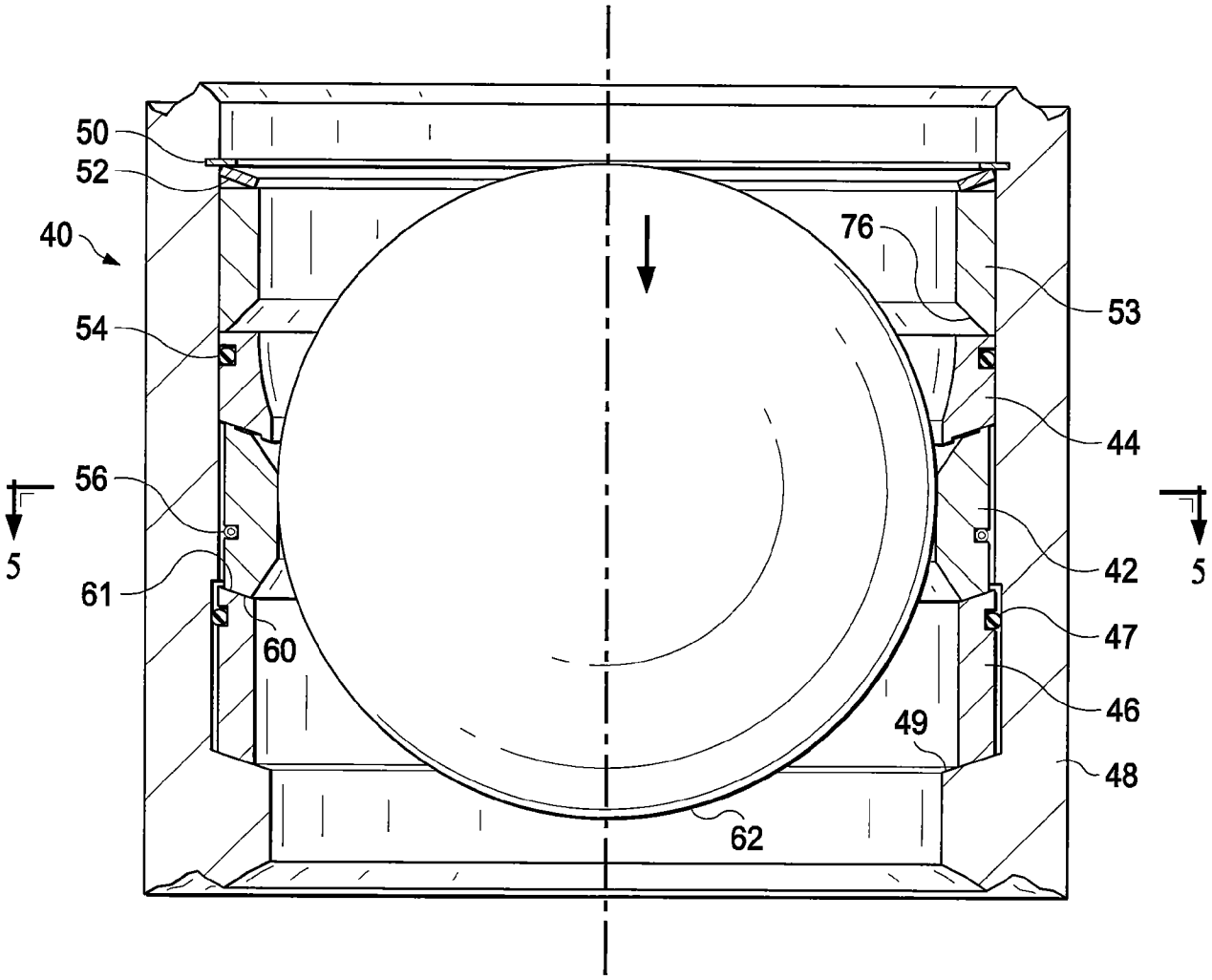
FIG. 4 illustrates the fracture plug seat assembly of FIG. 3 with the fracture plug seat allowing a ball to pass to a deeper zone.

FIG. 4 illustrates the fracture plug seat assembly 40 with a ball 62 passing through the expandable ring 42. The diameter of the ball 62 is smaller than the diameter of the axial opening of the setting ring 44 and therefore is not large enough to engage and land on the setting ring 44. The diameter of the ball 62 is larger than the diameter of the axial opening of the expandable ring 42 and exerts sufficient force on the expandable ring to overcome the spring force of spring 56 causing the split 58 to open and allow the ball 62 to pass through the axial opening of the expandable ring 42.

Figure 5:
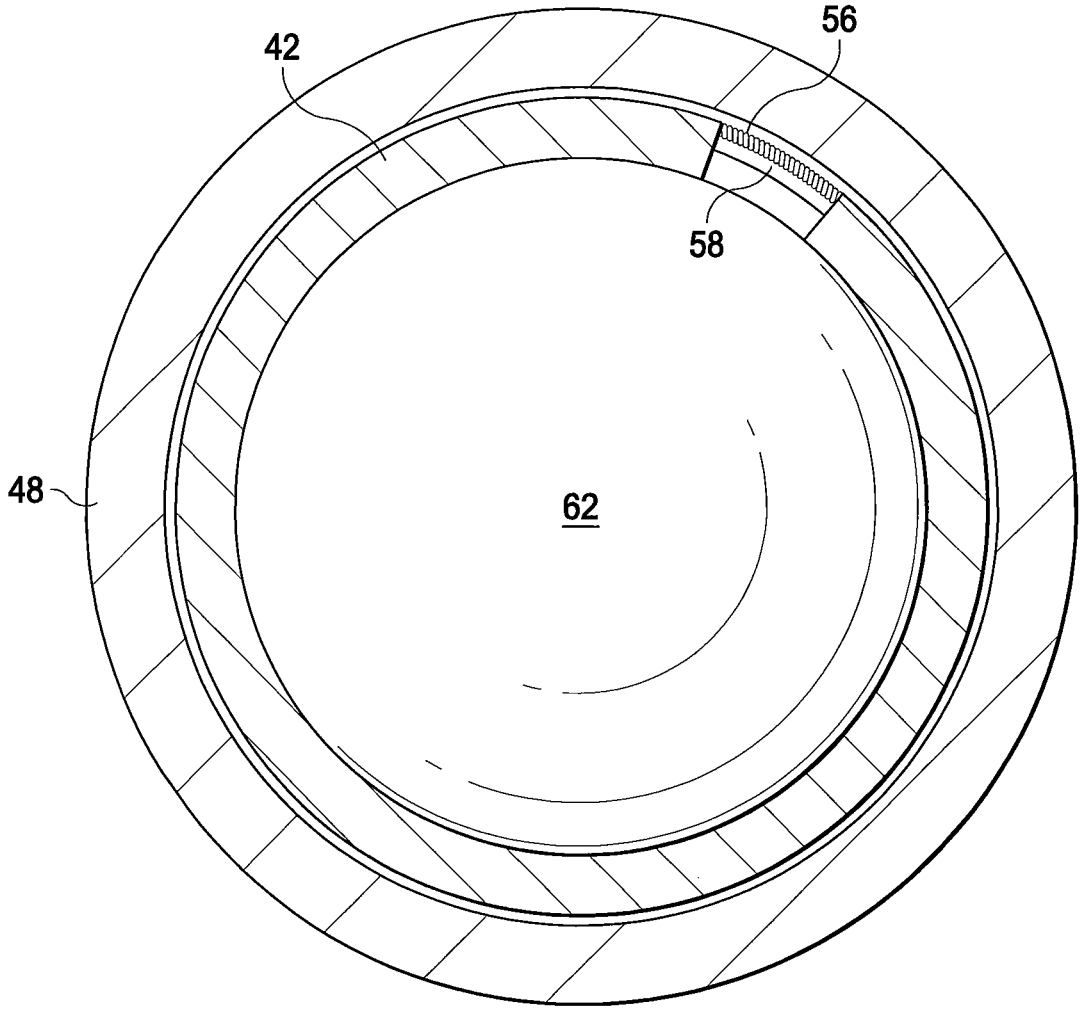
FIG. 5 illustrates a cross-section taken along line 5-5 of FIG. 4.

FIG. 5 is an axial view of the fracture plug seat assembly taken along line 5-5 of FIG. 4 showing the expandable ring 42 with the spring 56 in tension and the split 58 in the open position. The ball 62 is pressed within the inner diameter of the expandable ring 42.

Figure 6:
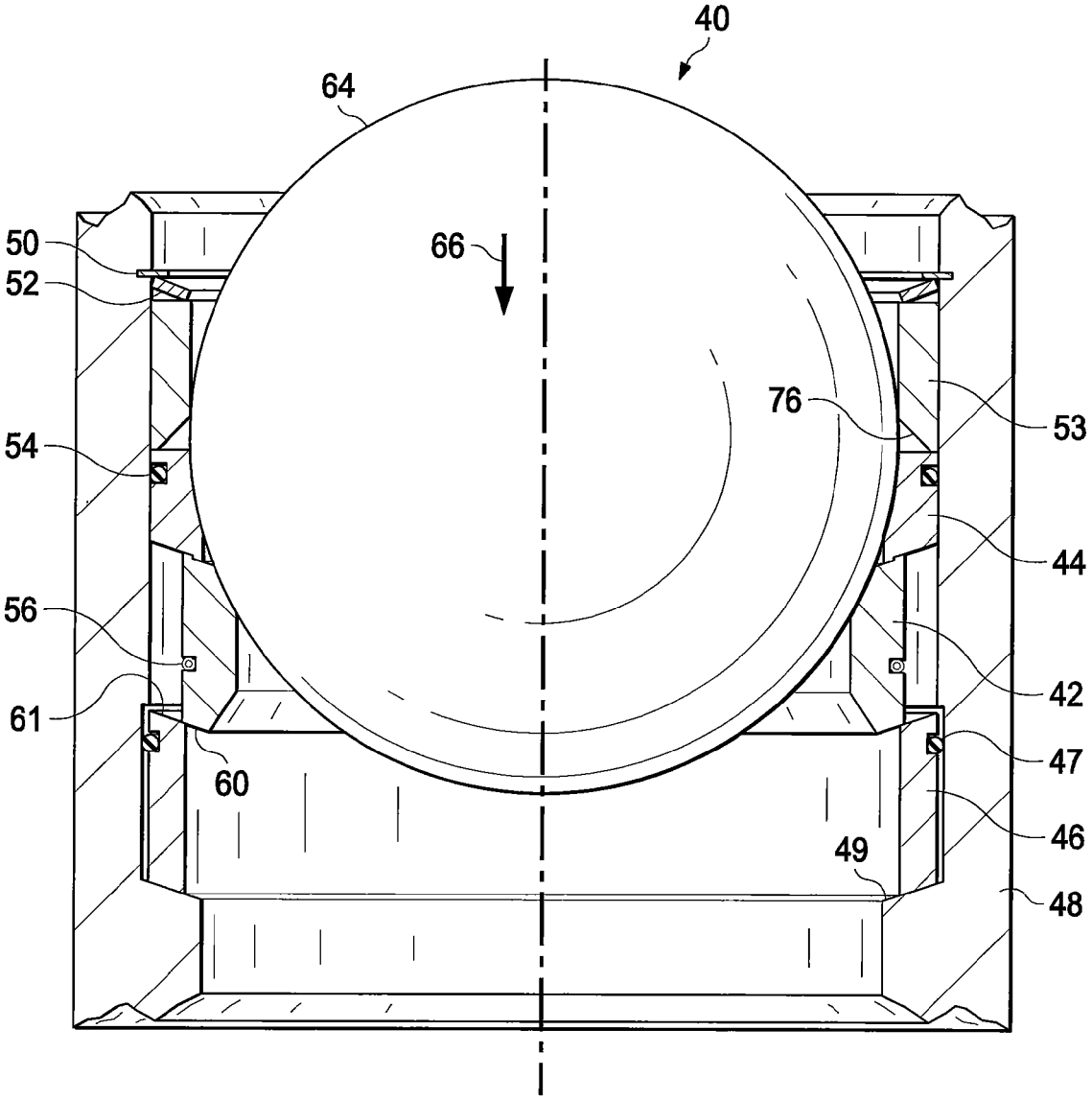
FIG. 6 illustrates the fracture plug seat assembly of FIG. 3 with a ball landed on the seat of the fracture plug seat assembly and applying pressure to the fracture plug seat assembly which is in an unlocked position.

FIG. 6 illustrates the fracture plug seat assembly 40 with a ball 64 which has been dropped in the direction 66 and is engaged with and landed on the setting ring 44. Significant pressure from the upstream side of the ball 64 forces the setting ring 44 downwardly against the expandable ring 42. As the setting ring 44 is forced further downward toward the lower ring 46, force builds on the tapered surface 60 of the expandable ring 42 and the tapered surface 61 of the lower ring 46 causing the lower ring 46 to expand.

Figure 7:
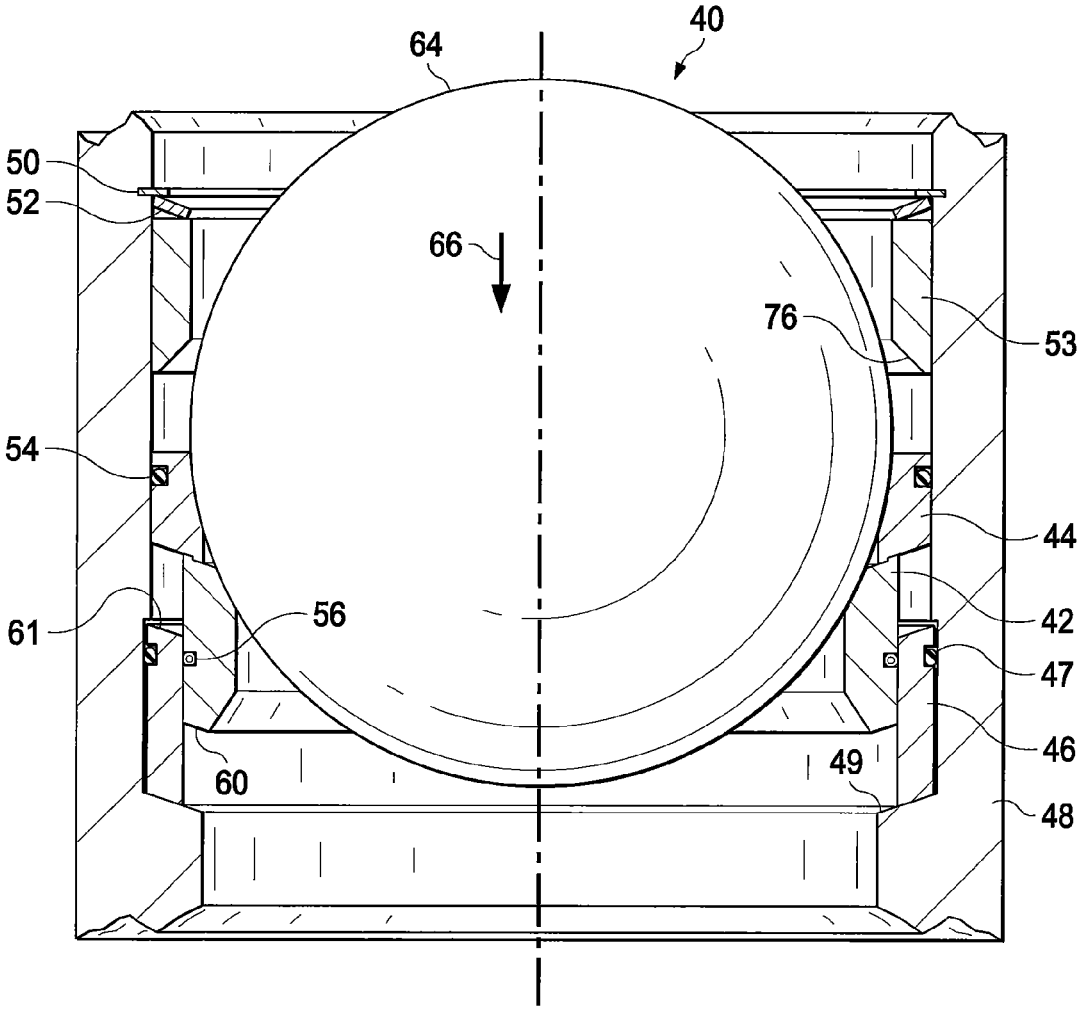
FIG. 7 illustrates the fracture plug seat assembly of FIG. 3 with a ball landed on the seat of the fracture plug seat assembly and in which the fracture plug seat is in a position between the unlocked position shown in FIG. 6 and a locked position shown in FIG. 8.

FIG. 7 illustrates the fracture plug seat assembly 40 with a ball 64 which has been dropped in the direction 66 and is engaged with and landed on the setting ring 44. Pressure from the upstream side of the ball 64 has caused the lower ring 46 to expand to the point at which tapered surface 61 of the lower ring 46 is disengaged from the tapered surface 60 of the expandable ring 42 and the expandable ring 42 is in a concentric relationship with the lower ring 46. Continued pressure from the upstream side of the ball forces the expandable ring 42 downward with respect to the lower ring 46.

Figure 8:
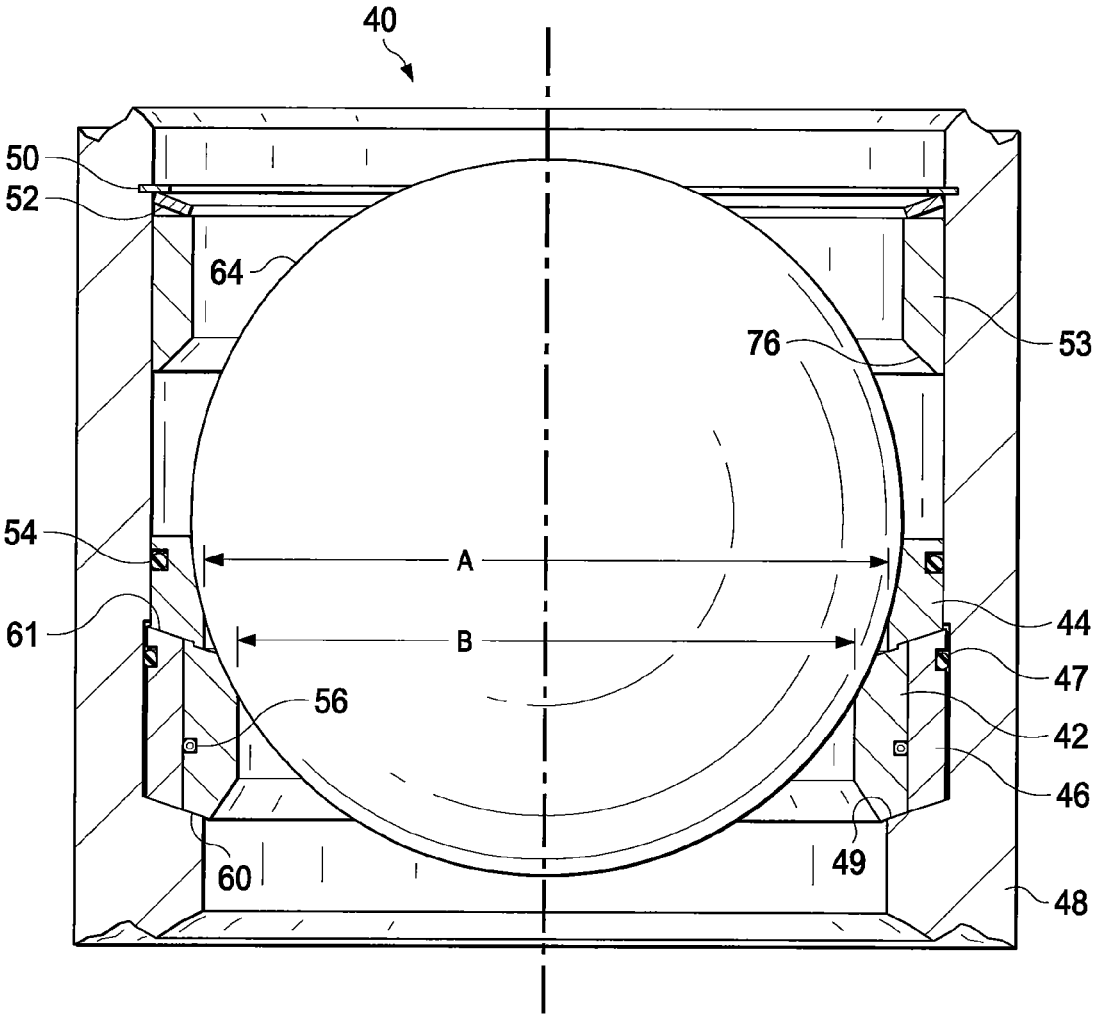
FIG. 8 illustrates the fracture plug seat assembly of FIG. 6 with the fracture plug seat in the locked position.

FIG. 8 illustrates the fracture plug seat assembly 40 in the condition in which the expandable ring 42 has been forced downward with respect to the lower ring 46 until the tapered surface 60 of the expandable ring 42 engages shoulder 49 of the sleeve 48. As shown in FIG. 8, the expandable ring 42 is in a retracted, locked position characterized by a concentric relationship with the lower ring 46. The ball 64 is now supported by the setting ring 44 and the expandable ring 42. Many prior art fracture plug seat designs only support a ball such as ball 64 with the engagement diameter A. This is because it is the smallest diameter of such designs that is capable of letting the preceding smaller ball 62 pass through. The engagement diameter B which corresponds to the diameter of the axial opening of the expandable ring 42 when it is in the locked position greatly adds to the support of ball 64 helping prevent the cracking or extrusion of the ball 64.

Figure 9:
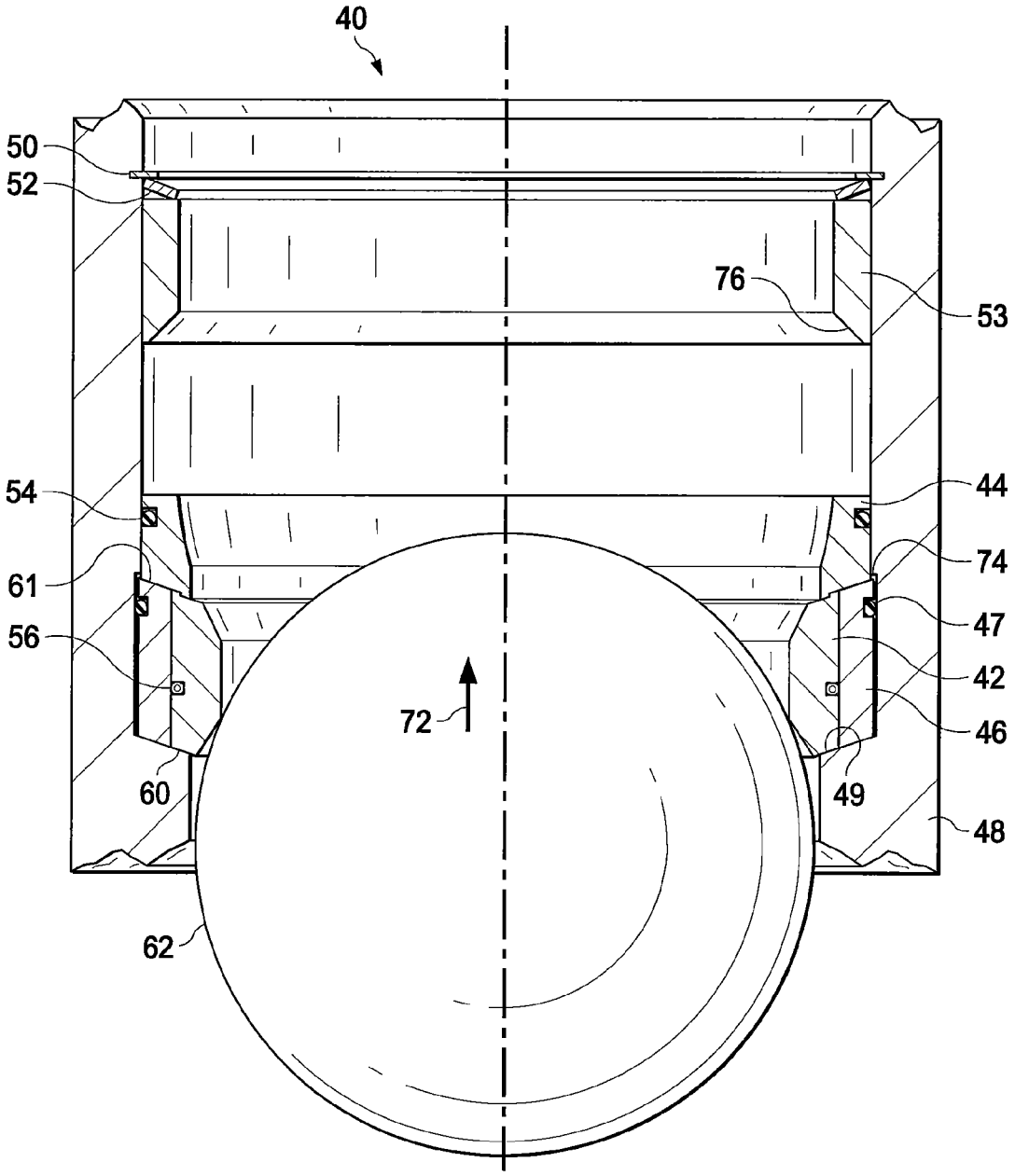
FIG. 9 illustrates the fracture plug seat assembly of FIG. 8 after the landed ball has been purged by reverse pressure and a downstream ball makes contact with the fracture plug seat which remains in the locked position.
Figure 10:
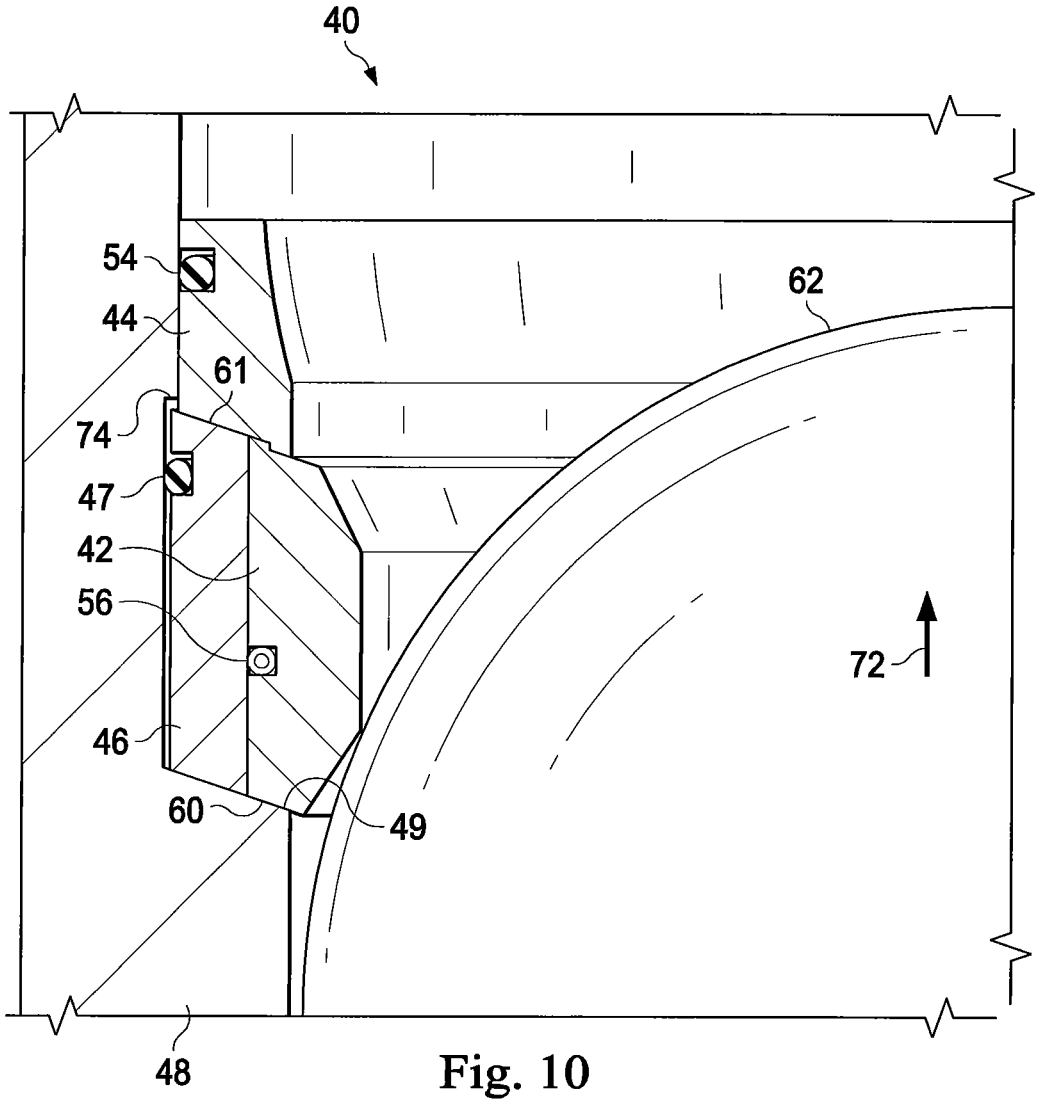
FIG. 10 illustrates a magnified view of a portion of the fracture plug seat assembly as shown in FIG. 9.
Figure 11:
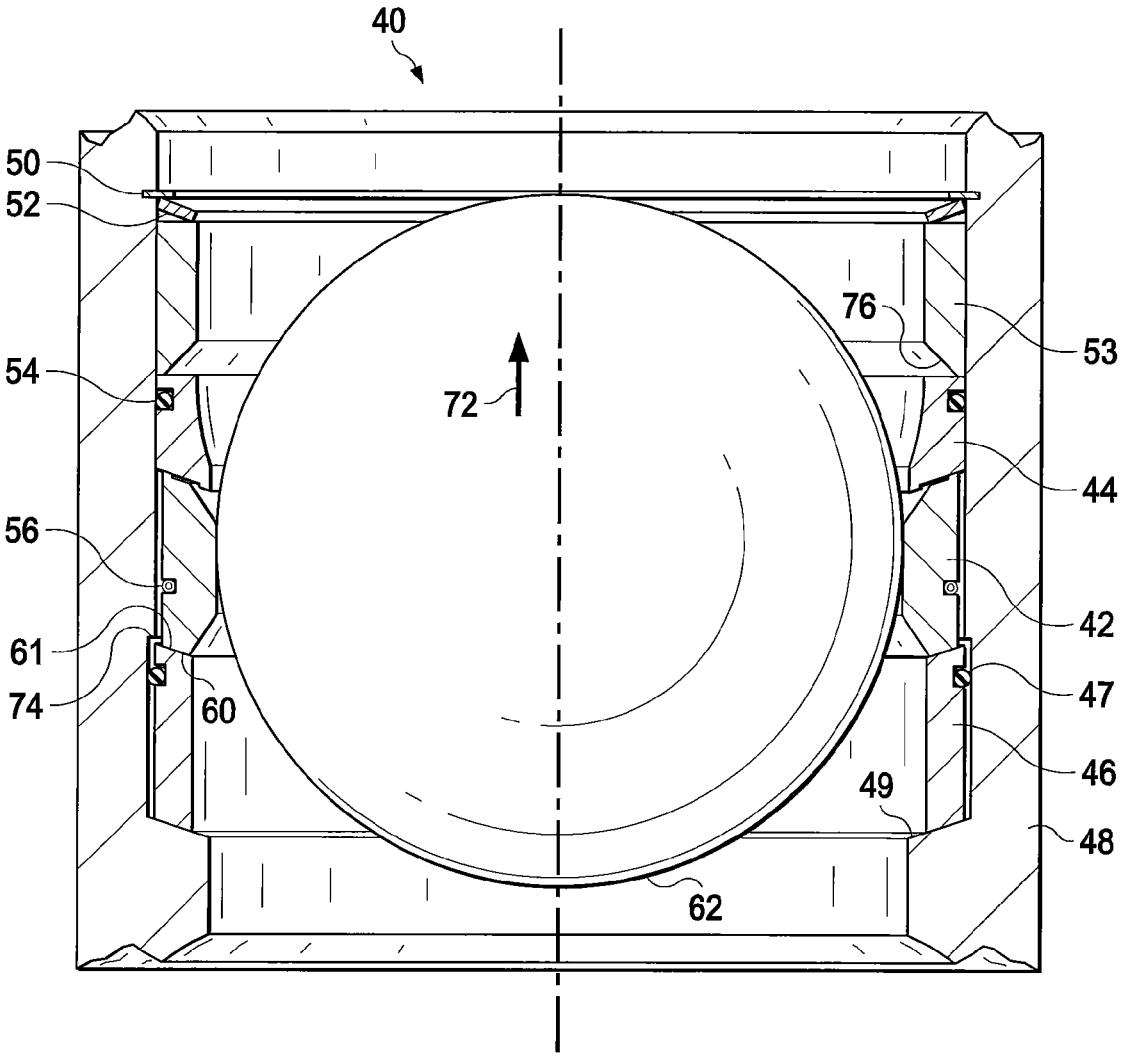
FIG. 11 illustrates the fracture plug seat assembly of FIG. 9 with a downstream ball passing through the fracture plug seat after it has been returned to an unlocked position by the downstream ball.

When fracturing is complete, the balls are often purged to the surface. FIGS. 9, 10 and 11 show the fracture plug seat assembly 40 with the larger ball 64 now purged up the well. In FIGS. 9 and 10, the smaller ball 62 has engaged the expandable ring 42 and pressure in the direction 72 is applying an upward force upon the fracture plug seat assembly 40. As shown in FIGS. 9 and 10, the sleeve 48 includes a step 74 which prevents the lower ring 46 from moving upwards. Thus, as pressure in the direction 72 continues, the expandable ring 42 moves upward with respect to the lower ring 46 and pushes the setting ring 44 ahead of the expandable ring 42. When the expandable ring 42 and setting ring 44 are moved to their original position as shown in FIG. 3, the expandable ring 42 is allowed to expand and the ball 62 passes through, as shown in FIG. 11. Tapered surface 76 on the annular spacer 53 prevents the setting ring 44 from moving upward any further and deflects any sand that might have accumulated during fracturing.

Figure 12:
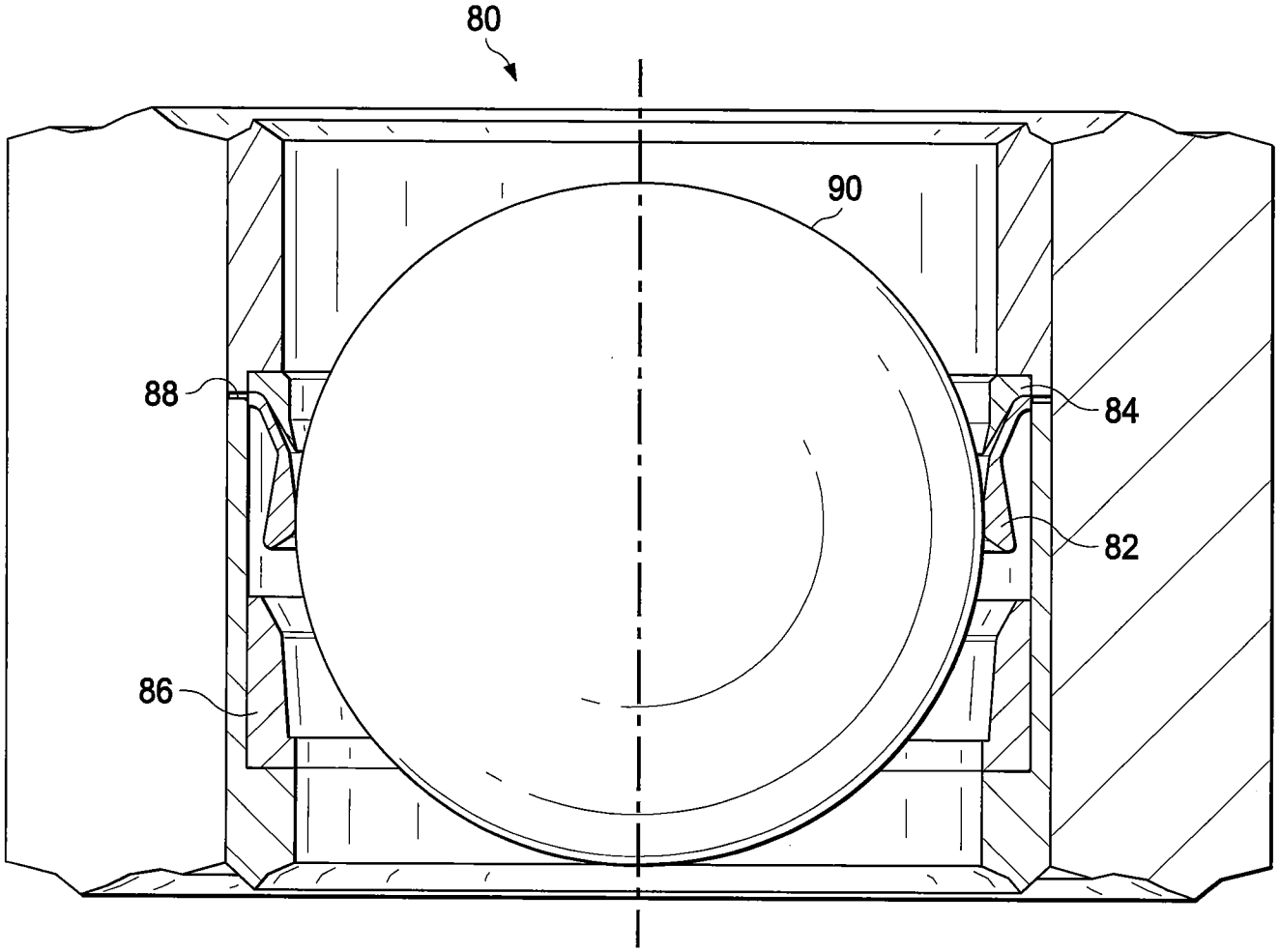
FIG. 12 illustrates a cross-section of an embodiment of a fracture plug seat assembly of the present invention in which the fracture plug seat incorporates a collet style expandable ring. In this illustration a ball is passing through the collet.
Figure 13:
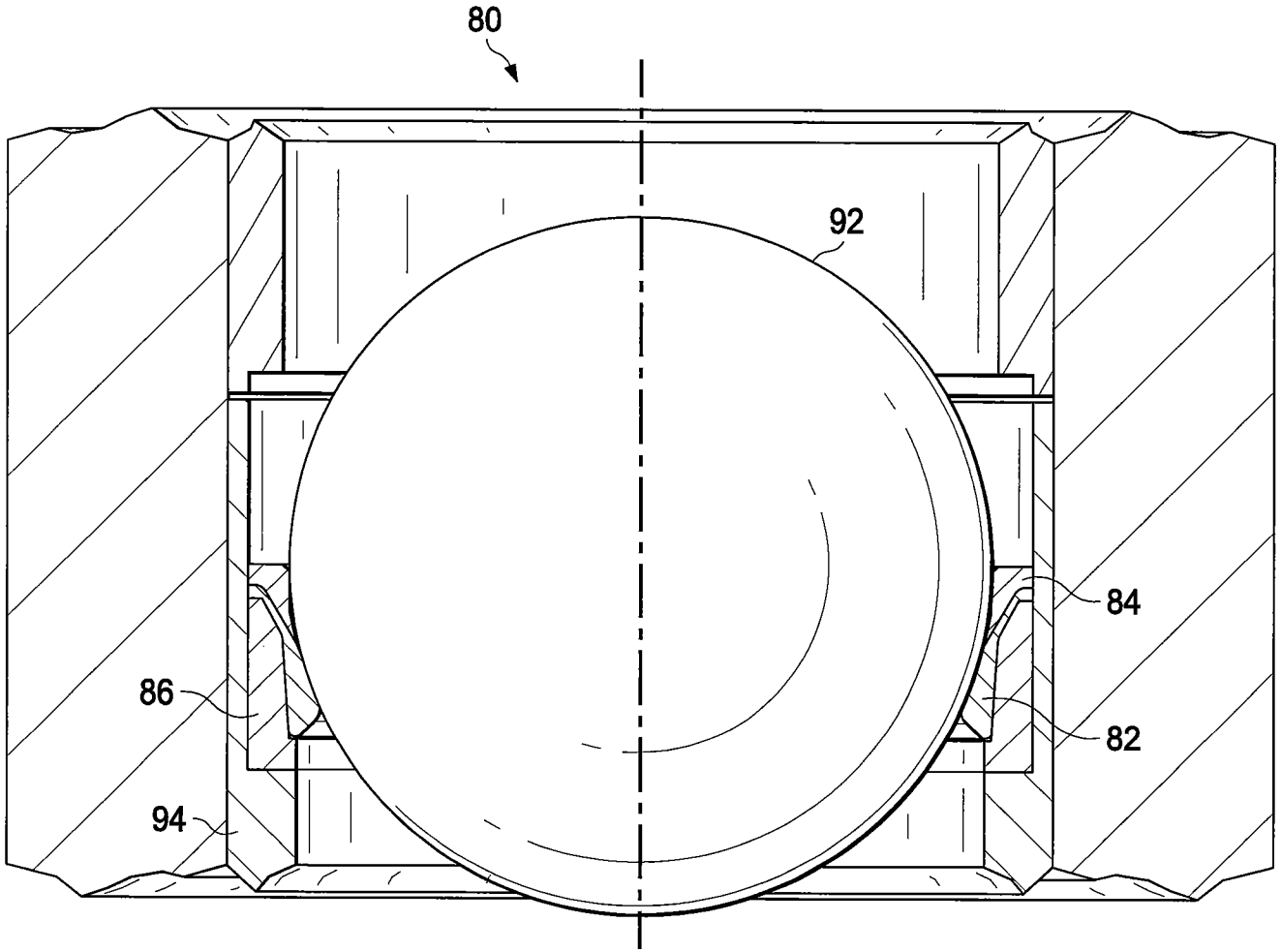
FIG. 13 illustrates the fracture plug seat assembly of FIG. 12 with a ball landed on the seat of the fracture plug seat assembly and applying pressure to the fracture plug seat assembly so as to be in a locked position.

Another embodiment of the present invention is illustrated in FIGS. 12 and 13. FIG. 12 shows a fracture plug seat assembly 80 which includes an expandable ring 82, a setting ring 84 and a lower ring 86. According to this embodiment, the expandable ring 82 is a collet with only one end expanding, and with one or more axial slits extending up the length of the expandable ring 82. A shear tab 88 prevents the expandable ring 82 from sliding down the assembly 80. In FIG. 12, a ball 90 is shown passing through expandable ring 82. As shown in FIG. 13, when a ball 92 designed to be landed by the fracture plug seat assembly 80 is dropped onto the seat assembly 80, it engages the setting ring 84 and moves the expandable ring 82 into a nested relationship with the lower ring 86. In some embodiments, the lower ring 86 is integrated with the sleeve 94.

Figure 14:
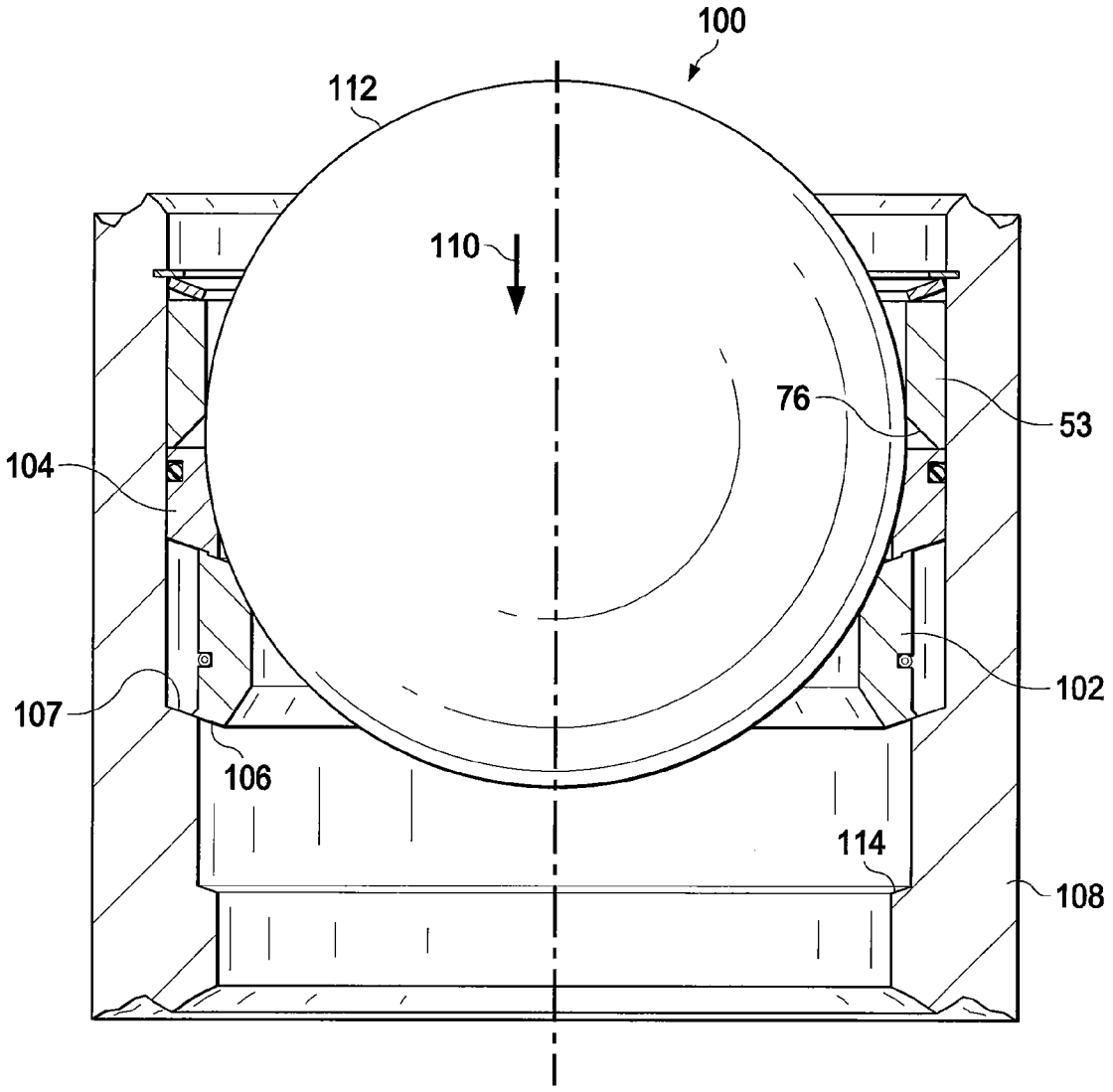
FIG. 14 illustrates a cross-section of an embodiment of a fracture plug seat assembly of the present invention with a ball landed on the seat of the fracture plug seat assembly.

Yet another embodiment of the present invention is illustrated in FIG. 14 in which the lower ring is integrated into the sleeve and in which a shear member is included, both as mentioned above. Specifically, FIG. 14 shows a fracture plug seat assembly 100 which includes an expandable ring 102 and a setting ring 104. According to this embodiment, the expandable ring 102 rests upon a tapered shoulder 107 which is integrated into sleeve 108. A shear tab 106 is provided on the expandable ring 102 and provides diametrical interference between the expandable ring 102 and the sleeve 108. A ball 112 has been dropped in the direction 110 and is engaged with and landed on the setting ring 104. Significant pressure from the upstream side of the ball 112 forces the setting ring 104 downward and into the expandable ring 102. As the setting ring 104 is forced further downward toward the expandable ring 102, force builds on the expandable ring 102 causing the shear tab 106 to shear and allow the expandable ring 102 to clear the tapered shoulder 107 and move downward with respect to the sleeve 108 until the expandable ring 102 is engaged with the shoulder 114 which is integrated into sleeve 108. When this occurs, the expandable ring 102 is in a locked position characterized by a concentric relationship with the lower ring sleeve 108.

In a manner similar to that described above with respect to FIGS. 9, 10 and 11, when fracturing is complete, the balls are often purged to the surface. When a ball smaller than ball 112 engages the expandable ring 102, pressure in a direction opposite direction 110 applies an upward force upon the fracture plug seat assembly 100. As pressure in the direction opposite direction 110 continues, the expandable ring 102 moves upward with respect to the sleeve 108 and pushes the setting ring 104 ahead of the expandable ring 102. When the expandable ring 102 and setting ring 104 are moved to their original position as shown in FIG. 14, the expandable ring 102 is allowed to expand and the ball smaller than ball 62 passes through, similar to what is shown in FIG. 11.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

What is claimed is:

1. Wellbore fracturing apparatus comprising:

a tubular member; and an annular fracture plug seat assembly coaxially carried within said tubular member, said annular fracture plug seat assembly being operative to permit axial passage therethrough and exit therefrom of fracture ball plugs only of diameters less than a predetermined magnitude, said annular fracture plug seat assembly including:

an expandable ring expandable from a first condition having a smaller first width to a second condition having a larger second width, the expandable ring having a default condition that is biased to the smaller first width, and an expansion control structure, operative, in response to entry and forcible engagement of said annular fracture plug assembly by an axially moving fracture ball plug having a diameter equal to or greater than said predetermined magnitude, to axially displace said expandable ring within said tubular member and then utilize the axially displaced expandable ring to block the axially moving fracture ball from exiting said annular fracture plug seat assembly.

2. The wellbore fracturing apparatus of claim 1 wherein: said expansion control structure further includes a second ring structure coaxially disposed on a ball exit side of said expandable ring.

3. The wellbore fracturing apparatus of claim 2 wherein: the axially displaced expandable ring is telescoped within said second ring structure so that the expandable ring engages an inner cylindrical surface of the second ring.

4. The wellbore fracturing apparatus of claim 3 wherein: said second ring structure is integrated with said tubular member and diametrically restricts the axially displaced expandable ring structure such that the expandable ring internal diameter is insufficient to permit passage of the axially moving fracture ball plug therethrough.

5. The wellbore fracturing apparatus of claim 1 wherein: said expansion control structure further includes a setting ring coaxially disposed on a ball entry side of said expandable ring, said setting ring and said expandable ring being configured in manners such that both may be forcibly engaged by the axially moving fracture ball plug and axially displaced thereby relative to said tubular member in the direction of fracture ball plug travel until said expandable ring reaches a displaced limit position.

6. The wellbore fracturing apparatus of claim 5 wherein: said expandable ring and said setting ring are further configured in a manner such that when said expandable ring reaches said displaced limit position thereof, each of said expandable ring and said setting ring blocks exit of the axially moving fracture ball plug from said annular fracture plug seat assembly.

7. The wellbore fracturing apparatus of claim 6 wherein: when said expandable ring reaches said displaced limit position thereof, said setting ring contacts and blocks exit of the axially moving fracture ball plug along a first circular contact area, and said expandable ring contacts and blocks exit of the axially moving fracture ball plug along a second circular contact area having a diameter less than that of said first circular contact area.

8. The wellbore fracturing apparatus of claim 1 wherein: said expansion control structure further includes a setting ring member disposed on a fracture ball plug entry side of said expandable ring, and a second ring structure disposed on a fracture ball plug exit side of said expandable ring, said setting ring and said expandable ring, and said expandable ring and said second ring structure, having complementarily and slidingly engaged sloping surfaces that function, when said setting ring is forcibly moved toward the fracture ball plug exit end of said annular fracture plug seat assembly, to diametrically contract said expandable ring and move it into an inwardly telescoped relationship with said second ring structure.

9. The wellbore fracturing apparatus of claim 8 wherein: said expandable ring is a first expandable ring, said second ring structure is a second expandable ring, and said first expandable ring, when inwardly telescoped into said second expandable ring, expands said second expandable ring and is itself restricted therein against diametrical expansion.

10. The wellbore fracturing apparatus of claim 9 wherein: with said first expandable ring inwardly telescoped into said second expandable ring, said first expandable ring, said second expandable ring, and said setting ring are configured to be returned to their original positions within said tubular member in response to movement of a fracture ball plug through said annular fracture plug seat assembly from the ball exit end thereof to the ball entrance end thereof.

11. The wellbore fracturing apparatus of claim 1 wherein: said expandable ring includes a split ring diametrically restricted by an encircling spring.

12. The wellbore fracturing apparatus of claim 1 wherein: said expandable ring is a collet with one end thereof being diametrically expandable.

13. The wellbore fracturing apparatus of claim 1 wherein: said expandable ring is coupled to said tubular member by a shearable member.

14. The wellbore fracturing apparatus of claim 1 wherein: said tubular member is a sliding sleeve.

15. The wellbore fracturing apparatus of claim 1 wherein: said expansion control structure further includes a setting ring and a second ring structure between which said expandable ring is coaxially sandwiched.

16. The wellbore fracturing apparatus of claim 15 wherein: said second ring structure is integrated with said tubular member.

17. The wellbore fracturing apparatus of claim 15 wherein: said ring is a first expandable ring, and said second ring structure is a second expandable ring.

18. The wellbore fracturing apparatus of claim 17 further comprising:

a biasing structure operative to exert an axially compressive force on said first and second expandable rings and said setting ring.

19. Wellbore fracturing apparatus comprising:

a tubular member; and an annular fracture plug seat assembly coaxially carried within said tubular member, said annular fracture plug seat assembly being operative to permit axial passage therethrough and exit therefrom of fracture ball plugs only of diameters less than a predetermined magnitude, said annular fracture plug seat assembly including:

a first expandable ring, an expansion control structure, operative, in response to entry and forcible engagement of said annular fracture plug assembly by an axially moving fracture ball plug having a diameter equal to or greater than said predetermined magnitude, to axially displace said first expandable ring within said tubular member and then utilize the axially displaced expandable ring to block the axially moving fracture ball from exiting said annular fracture plug seat assembly, and a second expandable ring expandable to surround the first expandable ring or expandable into direct contact with an inner wall of the tubular member.

20. The wellbore fracturing apparatus of claim 19 wherein: the axially displaced first expandable ring expands the second expandable ring, is diametrically restrained thereby, and has a central opening with a diameter insufficient to permit passage of the axially moving fracture ball plug therethrough.

21. The wellbore fracturing apparatus of claim 20 wherein: said tubular member is in contact with and restrains further expansion of the expanded second expandable ring.

22. Wellbore fracturing apparatus comprising:

a tubular member; and a fracture plug seat assembly carried within said tubular member and comprising a ring having an axial opening that may be expanded from a first width to a larger, second width to permit passage therethrough of a fracture plug, said ring having a default condition that is biased to the first width, said ring being axially movable within said tubular member by a fracture plug passing through said fracture plug seat assembly in a first axial direction, from a first position in which said ring is diametrically constricted and capable of being diametrically expanded, and a second position in which said ring is restricted against diametrical expansion.

23. The wellbore fracturing apparatus of claim 22 wherein:

said ring in said second position is capable of being axially shifted back to said first position thereof by a fracture plug passing through said fracture plug seat assembly in a second axial direction opposite to said first axial direction.

24. A wellbore fracturing method comprising the steps of:

providing a fracture plug seat comprising a tubular member and an expansion control structure, the tubular member having an expandable ring coaxially disposed and axially translatable therein, the expandable ring being expandable from a first condition having a smaller first width to a second condition having a larger second width, the expandable ring having a default condition that is biased to the smaller first width;

operatively positioning said fracture plug seat in a wellbore; and using said expandable ring to selectively permit passage of fracture plugs through said fracture plug seat by radially expanding the seat to permit passage; and using said expandable ring to selectively block passage of fracture plugs through said fracture plug seat by using the expansion control structure to axially displace the expandable ring to a position preventing expansion of the expandable ring to the larger second width so that the axially displaced expandable ring structurally blocks the axially moving fracture plug from exiting said annular fracture plug seat assembly.

25. The wellbore fracturing method of claim 24 wherein:

said using said expandable ring to selectively permit passage includes positioning said expandable ring in a first axial position within said tubular member and passing a fracture plug in a downhole direction through said expandable ring without axially shifting said expandable ring away from said first position.

26. The wellbore fracturing method of claim 25 further comprising the step of:

causing the fracture plug to diametrically expand said expandable ring while it remains in said first position.

27. The wellbore fracturing method of claim 24 wherein:

said using said expandable ring to selectively block passage includes axially shifting said expandable ring from a first position within said tubular member in a downhole direction to a second position within said tubular member and subsequently utilizing the shifted expandable ring to block passage of a fracture plug through said fracture plug seat.

28. The wellbore fracturing method of claim 27 further comprising the step, performed subsequent to the performance of said using said expandable ring to selectively block passage, of:

returning said expandable ring to said first position from said second position by moving a fracture plug in an uphole direction through said fracture plug seat.

29. Wellbore fracturing apparatus comprising:

a tubular member; and an annular fracture plug seat assembly carried within said tubular member, said fracture plug seat assembly being operative to permit axial passage therethrough and exit therefrom of fracture ball plugs only of diameters less than a predetermined magnitude, said annular fracture plug seat assembly including a ring stack in which an expandable ring is coaxially sandwiched between a second ring structure and a setting ring, the expandable ring expandable from a first condition having a smaller first width to a second condition having a larger second width, the expandable ring having a default condition that is biased to the smaller first width.

30. The wellbore fracturing apparatus of claim 29 wherein:

said expandable ring is a first expandable ring, and said second ring structure is a second expandable ring.

31. The wellbore fracturing apparatus of claim 30 wherein:

said first expandable ring is diametrically retractable and telescopeable into said second expandable ring in response to an axially compressive force imposed on said ring stack.

32. The wellbore fracturing apparatus of claim 29 wherein:

said second ring structure is integrated with said tubular member.

33. The wellbore fracturing apparatus of claim 32 wherein:

said expandable ring is diametrically retractable and telescopeable into said second ring structure in response to an axially compressive force imposed on said ring stack.

34. The wellbore fracturing apparatus of claim 29 wherein:

said setting ring is a fixed diameter ring.

35. Wellbore fracturing apparatus operably positionable in a wellbore, comprising:

a tubular member extending along an axis;

an annular seat structure coaxially supported within said tubular member and being diametrically expandable, said annular seat structure having an annular, conically tapered side surface and being coaxially sandwiched between and contacted by first and second annular surfaces, one of which slidingly and complementarily engages said annular, conically tapered side surface of said annular seat structure; and a spring structure arranged to apply a constant biasing force to hold said one of said first and second annular surfaces in contact with said annular, conically tapered side surface of said annular seat structure in a manner maintaining concentricity between said annular seat structure and said tubular member.

36. The wellbore fracturing apparatus of claim 35 wherein:

said annular seat structure has a second annular, conically tapered side surface opposite from said first-mentioned annular, conically tapered side surface, and the other one of said first and second annular surfaces slidingly and complementarily engages said second annular, conically tapered side surface of said annular seat structure.

37. The wellbore fracturing apparatus of claim 35 wherein:

said wellbore fracturing apparatus is a fracture plug seat assembly.

* * * * *